United States Patent [19]

Stowe et al.

[11] 4,157,484

[45] Jun. 5, 1979

[54] PIP INVERTER TUBE CATHODE HOUSING

[75] Inventors: Grady K. Stowe; Lynn E. Paul, both of Dallas, Tex.

[73] Assignee: Varo, Inc., Garland, Tex.

[21] Appl. No.: 880,019

[22] Filed: Feb. 21, 1978

[51] Int. Cl.[2] ..... H01J 39/02

[52] U.S. Cl. ..... 313/94; 316/20; 313/101

[58] Field of Search ..... 313/94, 101, 102, 99, 313/95; 250/213 VT

[56] References Cited

U.S. PATENT DOCUMENTS 2,864,022 12/1958 Day ..... 313/94

*Primary Examiner*—Robert Segal

*Attorney, Agent, or Firm*—Richards, Harris & Medlock

[57] ABSTRACT

A photocathode internally processed image intensifier inverter tube includes a cathode housing having an outer side wall forming a cylindrical opening for connection to the photocathode of the inverter tube. The side wall forms a cylindrical cavity in which the photocathode is received. A pair of flat wall surfaces are formed in the side wall. The flat surfaces are spaced radially inwardly such that the distance from the surfaces to the center of the cylindrical opening is less than the radius of the cylindrical opening. A tubular processing side arm is attached from each flat wall surface and are used to introduce antimony and alkali metal vapor, under a vacuum into the cathode housing for the deposit of a photosensitive coating on the photocathode substrate. After forming the photosensitive surface, the side arms are sealingly pinched off at the ends thereof to maintain a vacuum inside the inverter tube. The flat surfaces are positioned relative to the outer side wall and the side arms extend a specified distance from the flat wall surfaces such that the arms do not extend beyond the diameter of the side walls forming the cylindrical opening.

22 Claims, 7 Drawing Figures

PIP INVERTER TUBE CATHODE HOUSING

FIELD OF THE INVENTION

The present invention relates to a photocathode internally processed (PIP) image intensifier tube. More specifically, the invention is directed for the photocathode housing of an image intensifier tube.

BACKGROUND OF THE INVENTION

Prior Art

For some time, image intensifier tubes have been used in a variety of applications for direct viewing at low light levels and near infrared regions of the spectrum. Image intensifier tubes have been used in a variety of military, scientific and industrial applications where assistance in viewing objects at low light levels is necessary. For example, the devices are used for telescopic observation of stellar bodies or in military applications to view dimly illuminated targets.

Image intensifier tubes are electro-optical devices which convert a low energy visible or invisible radiant image into an electron image by means of a photocathode. This image is increased in energy and reconstructed by a focusing electric field on a phosphor screen or a microchannel plate electron multiplier positioned in front of a phosphor screen. The radiant image is reconverted on the phosphor screen to a brighter image of like or varied size.

The development of PIP image intensifier assemblies have progressed through three generations of units. The so called zero generation tubes were primarily infra-red tubes, internally processed. The performance and quality of these tubes were limited, and compact high gain devices could not be accomplished.

In first generation image intensifier tubes, the low light level image is incident upon a fiberoptic face plate which focuses the image on a photocathode where the photon image is converted into an electronic one. The electrons are accelerated toward a phosphor screen, while the spatial information is maintained by the electron optics. The accelerated electrons strike the phosphor, thus inducing an amplified image. Generally, three stages of intensifier stages are utilized in the first generation type.

Although the first generation of image intensifier tubes was impressive, certain deficiencies resulted from cascading the three stages of amplification. These deficiencies included: the added features of distortion and vignetting at each stage; the effective lengthening of the phosphor decay time, which produces streaking when a scene containing bright lights is viewed; and bright sources within the field of view causing blooming in each stage which can "wash out" the entire scene in severe cases.

After many years of development, a second generation image intensifier tube was developed. This second generation unit incorporated a microchannel plate comprised of a bundle of discrete hollow glass tubes or channels capable of amplifying an electron image by many orders of magnitude. As in the first generation of image intensifier tubes, the electron image in the second generation units are generated by a photocathode in response to the incident radiation image. However, the multiplied electron image from the microchannel plate is directed onto a phosphorus screen for providing an intensified display of the sensed radiation image without the need for stages of amplification.

Because the second generation tube produced sufficient gain in a single stage, streaking, distortion and vignetting was substantially reduced. Further, the ability of the microchannel plate to localize high current regions, resulting from bright sources, provides a system which reduces blooming and "wash out", resulting in a better contrast rendition through the system. Further, a single stage construction requires substantially less intensifier power than is required by the first generation image intensifier tubes.

In both the first and second generation image intensifier tubes of the internally processed type, the photocathode is formed by admission of an appropriate antimony metal and metal alkali vapor into the evacuated housing to the photocathode region through side arms mounted on the housing. A similar side arm connects to a getter wire to accomplish the deposition of the material for gas absorption. These side arm appendages are "pinched off" and removed after formation of the photocathode. The extension of the pinched off side arms generally dictate the minimum diameter for packaging the tube.

The zero generation image intensifier assemblies define a circumference slightly smaller than the circumference of both the first and the second generation image intensifier tubes. As a result, the prior art second generation intensifier tubes cannot be directly substituted into devices originally designed to receive the zero generation tubes. Thus, use of the improved first and second generation image intensifier tubes on devices originally designed to accept the zero generation tubes has required a complete reworking of the devices to accept the larger diameter first and second generation tubes.

Other image intensifier assemblies, such as the image intensifier commonly known as EPIC, have been developed which are of a size permitting their direct use in devices originally designed for the zero generation image intensifier tubes. However, these devices are substantially more expensively manufactured by the EPIC process. Thus, a need has arisen for a method of constructing the first and second generation tubes to permit their use in devices designed to accept the zero generation tubes without requiring a complete reworking of the optics geometry of the tubes or a reworking of the devices in which they are used.

SUMMARY OF THE INVENTION

The present invention provides an internally processed image intensifier inverter tube having residual side arms of a smaller radial protrusion than prior first and second generation intensifier tubes. The image intensifier of the present invention is sized to permit the retrofitting of the present image intensifier tube into devices originally designed to receive the zero generation image intensifier tubes. However, this is accomplished without disturbing the electron optics or the dimensions of the major components of the present first and second generation image intensifier tubes.

In accordance with one embodiment of the invention, a photocathode internally processed image intensifier inverter tube includes a cathode housing having an outer side wall forming a cylindrical opening for connection to the photocathode of the inverter tube. The side wall forms a cylindrical cavity in which the photocathode is received.

A pair of flat wall surfaces are formed in the side wall. The flat surfaces are spaced radially inwardly such that the distance from the surfaces to the center of the cylindrical opening is less than the radius of the cylindrical opening. A tubular processing side arm is attached from each flat wall surface and are used to introduce antimony and alkali metal vapor, under a vacuum into the cathode housing for the deposit of a photosensitive coating on the photocathode substrate. After forming the photosensitive surface, the side arms are sealingly pinched off at the ends thereof to maintain a vacuum inside the inverter tube.

The flat surfaces are positioned relative to the outer side wall and the side arms extend a specified distance from the flat wall surfaces such that the arms do not extend beyond the diameter of the side walls forming the cylindrical opening.

In one embodiment of the invention, the flat wall portions are positioned on opposite sides of the outer side wall of the cathode housing. In other embodiments, the flat wall portions may be positioned at desired angular positions around the cathode housing.

In accordance with another embodiment of the invention, an inner shield is provided having a circular side wall with an indention in the side wall in line with the side arm through which alkali metal vapor is admitted. The indention allows sufficient opening to permit entry of vapor into the outer side wall and acts to disperse vapor admitted therein. An aperture is formed through the side wall of the inner shield in line with the other side arm. This aperture allows positioning of the antimony from the other side arm into the cathode housing for formation of the photocathode.

In accordance with another embodiment of the invention, an annular bottom wall is attached to the bottom edge of the outer side wall and extends radially inwardly from the outer side wall. Structure is provided for maintaining the bottom edge of the indention in the inner shield above the annular bottom wall when the shield is mounted within the outer side wall of the housing. In this way, a gap is provided between the bottom edge of the indention and the bottom wall to permit flow of vapor therebetween.

The indention in the inner shield is formed with a substantially spherical upper portion positioned below the top of the outer side wall. A lower semicircular portion communicates between the upper spherical surface and the bottom edge of the side wall of the inner shield.

In accordance with still another embodiment of the invention, the structure for maintaining the bottom of the indention above the annular bottom wall includes a foot extension attached to the lower edge of the inner shield side wall for raising the lower edge of the shield above the annular bottom wall.

In accordance with still another embodiment of the invention, a transverse step is formed between the upper end of the flat wall portion and the outer side wall. A mating annular flange extends transversely and outwardly from the side wall of the inner shield. When the inner shield is assemblied within the outer side wall, the annular flange of the inner shield mates with the annular step formed above the flat wall portion.

In the process of forming a photocathode internally process image intensifier tube of the present invention, a photocathode housing is formed having a cylindrical outer wall defining a cylindrical cavity in which the photocathode is received. A pair of flat wall surfaces are formed along the circumference of the outer side wall. The flat wall surfaces are positioned radially inwardly such that their radial distance from the center of the photocathode housing is less than the radius of the outer wall of the housing.

Apertures are formed through each of the flat wall surfaces in the outer wall housing. A circular vapor shield is provided and has an indention in one side thereof. The circular shield is inserted within the outer wall of the photocathode housing such that the indention is adjacent one of the apertures in the flat wall surface of the outer side wall. An alkali vapor generator source is attached to the photocathode housing through a tubular side arm attached to the aperture adjacent the indention in the vapor shield. An antimony metal vapor source is attached to the photocathode housing through a tubular side arm to the other aperture in the outer side wall of the housing. Under a vacuum, vapor from selective antimony metals and on alkali metal vapor are also admitted into the photocathode housing for deposit on the photocathode. Upon completion of the coating process, the side arms through which the alkali metal vapor and the antimony metal vapor are injected into the housing are crimped and sealed at a point such that the arms do not extend beyond the diameter of the outer side walls of the cathode housing. In this way, the indention provides an image intensifier tube with residual side arms having a shorter radial protrusion without redesign of the electron optics.

BRIEF DESCRIPTION OF THE DRAWINGS

For a more complete understanding of the present invention and for further details and advantages thereof, reference is now made to the following description taken in conjunction with the accompanying drawings, in which.

DESCRIPTION OF THE PREFERRED EMBODIMENT

The present invention provides a photocathode internally processed image intensifier tube of the second generation type which may be retrofitted into devices constructed to accept the somewhat smaller in diameter zero generation image intensifier tubes. This is achieved without disturbing the electron optics of the second generation image intensifier tube or requiring changes in the photocathode processes.

Figure 1:
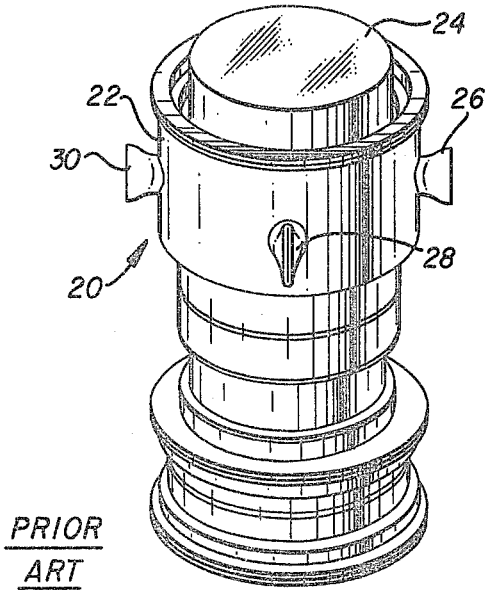
FIG. 1 is a perspective view of a prior art internally processed image intensifier tube of the second generation type.

FIG. 1 illustrates a prior art second generation image intensifier tube. The prior art second generation tube, identified generally in FIG. 1 by the numeral 20, includes an outer housing 22 with a photocathode 24 protruding from the upper end of housing 22. The prior art image intensifier tubes also are formed with a plurality of residual side arms 26, 28 and 30 which extend beyond the greatest radius of any portion of housing 22. Prior to being crimped off, side arms 26 and 30 are tubes through which alkali vapor and an appropriate antimony metal are injected to the photocathode region, as will be discussed hereinafter in greater detail. Side arm 28 is the crimped off remainder of the getter wire tube used in initial construction of the device. Residual side arms 26, 28 and 30 remain as protrusions from housing 22 when the tubes used to introduce an antimony metal and metal alkali vapor to the photocathode are crimped off and sealed.

As has heretofore been mentioned, the zero generation image intensifier tubes are slightly smaller in diameter than corresponding second generation image intensifier tubes. While the second generation tubes are far superior in operation than the zero and first generation tubes, it has been impractical to merely scale down the size of the second generation tubes so that they may be used in the place of and retrofitted to devices originally designed to receive the zero generation tubes. Thus, a need has arisen for a structure which will not affect the optics of the second generation image inverter tubes but will house the components of the second generation tube and also retrofit those devices originally designed to receive the zero generation image intensifier tubes.

The present invention provides such a structure by providing a photocathode housing which permits the residual side arms to be moved radially inwardly such that in their final crimped state they do not project beyond the outer diameter of the photocathode housing or other housing components. The image intensifier tube of the present invention is illustrated in FIGS. 2 through 7, with FIGS. 2 and 4 showing the image intensifier tube during the process of depositing a photosensitive coating on the photocathode substrate of the image intensifier tube.

Figure 2:
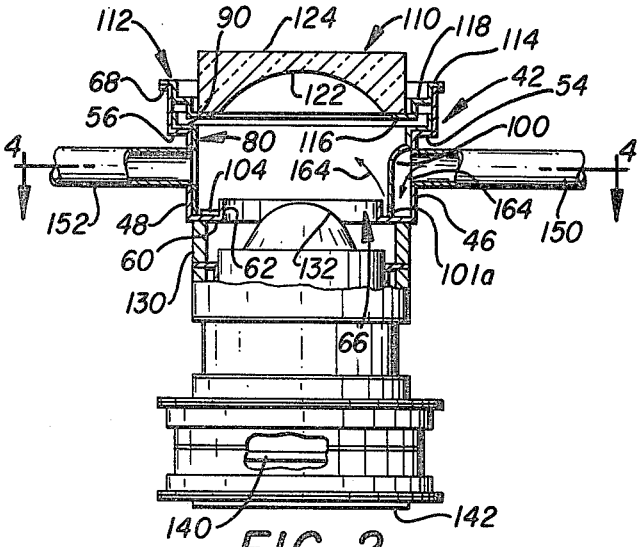
FIG. 2 is a plan view, partially broken away, of the internally processed image intensifier tube of the present invention prior to removal of the processing side arms.
Figure 4:
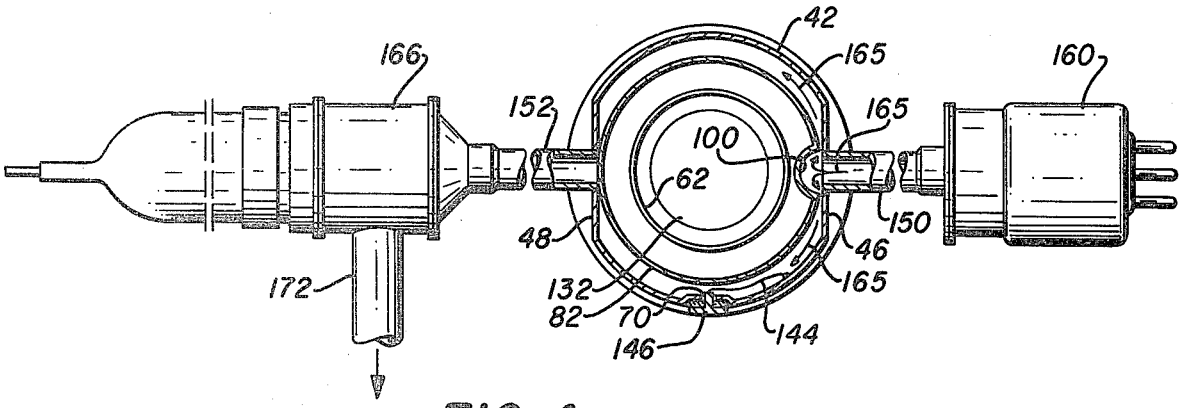
FIG. 4 is a top view, partially in section taken along line 4—4 of FIG. 2 and further showing the antimony and alkali generators used in forming the photocathode of the intensifier tube.
Figure 3:
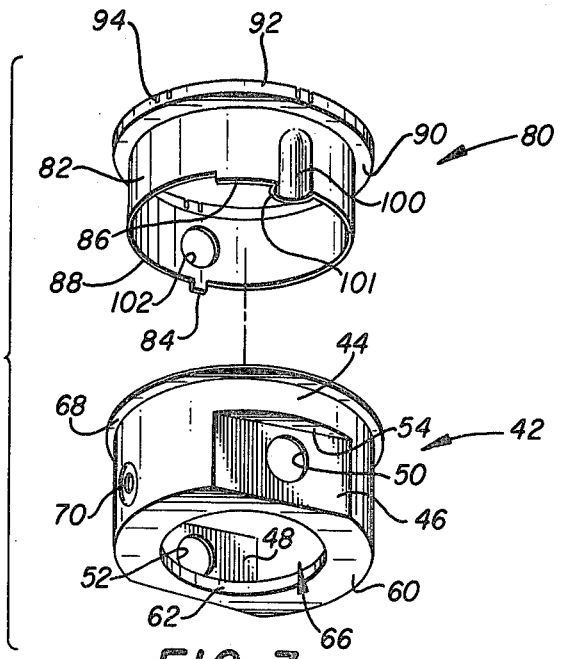
FIG. 3 is an exploded perspective view showing the photocathode housing and vapor shield.

Referring to FIGS. 2, 3 and 4, the image intensifier tube includes a photocathode housing 42. As can best be seen in FIG. 3, photocathode housing 42 has a cylindrical side wall 44 with flats 46 and 48 formed thereon at opposite sides of side wall 44. Flat 46 has an aperture 50 formed therein, and flat 48 has an aperture 52 formed therein. A transverse step 54 is formed as the transition wall from flat 46 to wall 44, and a similar transverse step 56 is formed as the transition wall between flat 48 and wall 44. Photocathode housing 42 has an annular bottom wall 60 with an upwardly facing annular flange 62 forming a lower aperture 66 in photocathode housing 42.

An outturned annular flange 68 is formed at the upper end of side wall 44 and defines the outermost diameter of the image intensifier inverter tube of the present invention. A gettering aperture 70 (FIG. 3) is formed in side wall 44 of the photocathode housing. Gettering aperture 70 is positioned intermediate of flange 68 and bottom wall 60 of the housing.

Referring to FIGS. 2 and 3, a vapor shield 80 is fitted within photocathode housing 42. Shield 80 includes a circular side wall 82 with a narrow foot protrusion 84 and a broader foot protrusion 86 extending below the lower edge 88 of side wall 82. A transverse annular step flange 90 is attached to the upper circumference of side wall 82 and an upturned flange 92 of a larger diameter than side wall 82 extends upwardly from flange 90. Flange 92 has a plurality of notches 94 spaced around the circumference thereof to facilitate mounting vapor shield 80 into cathode housing 42.

An indention 100 is formed in side wall 82 over the foot extension 86. The indention extends from a lower surface 101 to a point near the upper area of side wall 82. As is shown in FIG. 2, lower surface 101 of indention 100 is angled slightly upwardly from the bottommost edge of foot extension 86 to provide a gap 101*a* between surface 101 and wall 60 when shield 80 is assembled into housing 42. An aperture 102 is formed in side wall 82 opposite indention 100 and immediately above foot extension 84.

As can be seen in FIGS. 2, 3 and 4, indention 100 and aperture 102 in vapor shield 80 are so formed, and vapor shield 80 is mounted into photocathode housing 42 such that indention 100 is adjacent aperture 50 in flat 46 and aperture 102 is adjacent aperture 52 in flat 48 of photocathode housing 42. Vapor shield 80 is engaged into photocathode housing 42 until foot extension 84 and foot extension 86 engage lower wall 60 of housing 42. As can be seen best in FIG. 2, flange 90 is so positioned such that it engages transverse steps 54 and 56 of housing 42 when foot extension 84 and foot extension 86 of vapor shield 80 is engaged against bottom wall 60 of housing 42. Foot extensions 84 and 86 position the lower edge 88 of shield 80 above bottom wall 60 of housing 42 to produce a gap 104 between edge 88 and wall 60.

Referring still to FIG. 2, a fiberoptic photocathode 110 is supported by a photocathode support plate 112 from housing 42. Support plate 112 has an annular flange 114 with an outer diameter equal to that of flange 68 of housing 42. Flange 114 mates with flange 68 of housing 42 and is fixed thereto by an appropriate means such as welding or brazing. A somewhat smaller diameter annular flange 116 is attached to flange 114 of support 112 by stairstep flange 118.

Photocathode 110 is received on flange 116 where it is frit sealed at its bottom surface 120. Photocathode 110 is formed with a spherical surface 122 and an opposite upper planar surface 124.

Cathode housing 42 is sealed to an electrical insulator spacer 130. Insulator spacer 130 may be constructed of any suitable material such as ceramic or glass. A cone 132 is supported at insulator 130 by cone mounting flange 134 secured to cone 132 and joined to insulator spacer 130 by brazing. A microchannel plate 140 is mounted in a spaced relationship from cone 132 by suitable surround structure and a fiberoptic phosphor screen assembly 142 is mounted below microchannel plate 140. A detailed description of cone 132, microchannel plate 140 and fiberoptic phosphor screen assembly 142 is omitted because the invention is concerned primarily with cathode housing 42. Thus, it will be understood that the present invention is readily adaptable to other types of image intensifier tubes which do not use a microchannel plate.

Referring now to FIG. 4, a gettering device is connected to housing 42 at aperture 70. The gettering device includes a titanium coated wire or other gas absorbing material 144 attached between the side wall of housing 42 and cap 146 which seals aperture 70 of housing 42. Attachment of cap 146 to housing 42 may be by any suitable means, such as by brazing.

The present invention uses the form of gettering device shown in FIG. 4 in place of gettering devices using a tube attached to the photocathode housing for inserting a gettering wire therein. Where a gettering tube is connected to the photocathode housing and later crimped off in the usual manner, a third flat, similar to flats 46 and 48, would be formed at aperture 70 such that the residual arm resulting from crimping off the gettering tube will not extend beyond the outer circumference of the cathode housing. However, in the primary embodiment of the invention, the use of an additional flat is avoided by the use of cap 146 which does not extend beyond the outer diameter of the cathode housing.

An alkali metal vapor tube 150 is attached to flat 46 of side wall 44 at aperture 50. Attachment may be by any suitable means such as brazing. Similarly, an antimony metal vapor tube 152 is attached to flat 48 of side wall 44 at aperture 52 by any suitable means, such as brazing.

In the production of photocathode internally processed image intensifier tubes, a photosensitive coating is deposited on spherical surface 122 of a photocathode substrate subsequent to the mounting of the photocathode substrate to support 112 and housing 42. This is accomplished by the admission of vapor of appropriate alkali metals such as cesium, sodium and potassium, from an alkali generator 160 through tube 150 into an envelope designated generally by numeral 162. Vapor is discharged from aperture 50 against idention 100 and downwardly through gap 101*a* between lower surface 101 and wall 60 along the path indicated by arrows 164 in FIG. 2. In this way, alkali vapor is indirectly injected into envelope 162. Alkali vapor also enters into envelope 162 by passage from the vapor shield area between side wall 82 of shield 80 and side wall 44 of housing 42 along the path identified by arrows 165. The vapor then flows under the lower edge 88 of shield 80 into the photocathode area.

Shield 80 prevents nonuniform coating of surface 122 of the photocathode by dispersing the vapor prior to its entry into envelope 162. Thus, "hot spots" or spots of heavy concentration of alkali metal on the photocathode is eliminated.

Prior to and during the injection of the alkali metal vapor into the photocathode area, antimony is admitted to the cathode region from an antimony generator 166 through tube 152 and through aperture 102 of shield 80. Because the antimony metal vapors sublime evenly as they are discharged in housing 42 from a point source, no shielding is required to assure uniform coating of the cathode.

Figure 5:
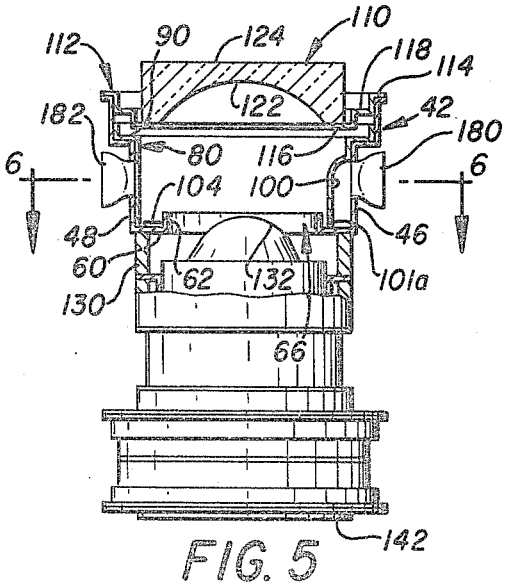
FIG. 5 is a plan view, partially broken away, of the present invention showing the invention with the processing side arms crimped off.

Through evaporation, the antimony metal and metal alkali are deposited on spherical surface 122 of photocathode 110. Throughout the process, a vacuum is drawn through line 172 of antimony generator 166, and envelope 162 is evacuated. While the vacuum is held, tubes 150 and 152 are mechanically cut and crimped off as shown in FIG. 5 to seal off envelope 162 and maintain a vacuum therein. It has been found that the severing of tubes 150 and 152 can be no closer to the photocathode housing than the diameter of the tube for the seal to be of sufficient integrity to maintain the vacuum required in the image intensifier tube.

Figure 6:
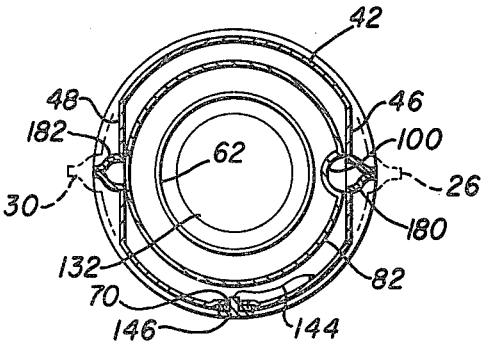
FIG. 6 is a section view taken along line 6—6 of FIG. 5, and showing in phantom the position of the processing side arms in the prior art PIP intensifier tubes.

As can be seen in FIGS. 5 and 6, because of the arrangement of flats 46 and 48 to which alkali vapor tube 150 and antimony vapor tube 152 are attached, the residual arms 180 and 182 remaining after severing of tubes 150 and 152 do not protrude beyond the diameter of the photocathode housing 42. Referring to FIG. 6, the position of the residual arms 180 and 182 are shown in comparison to the residual arms 26 and 30, in phantom, of the prior art image intensifier tube illustrated in FIG. 1. As shown, the radial protrusion of the residual side arms is reduced by the depth of flats 46 and 48. While the radial protrusion of the residual side arms is substantially reduced, the proper flow of alkali vapor into the photocathode area is maintained by the vapor shield with a relief depression in front of the alkali vapor admission tube. The depth of the indention 100 is sufficiently small and thus the electron optics in the cathode region are left undisturbed.

Figure 7:
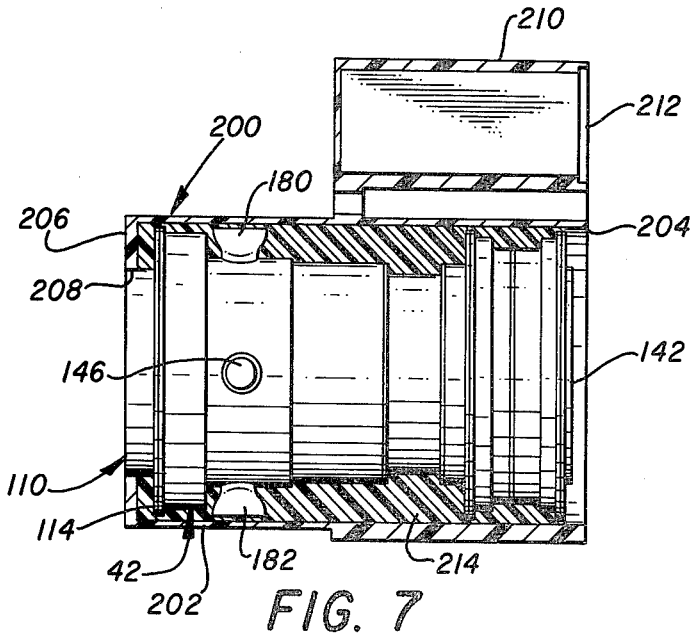
FIG. 7 is a section view showing the image intensifier tube of the present invention mounted in a housing.

FIG. 7 illustrates the image intensifier tube of the present invention mounted within a housing 200. The housing includes cylindrical side walls 202 defining an opening 204 at one end. An annular flange 206 extends inwardly from the opposite end and defines an aperture 208 for receiving photocathode 110 therein. A power supply housing 210 is attached to side wall 202 and has an opening 212 for receiving a power supply unit (now shown). After the image intensifier tube is inserted into housing 200, it is normally retained therein by the use of RTV rubber encapsulation 214 which is loaded between the image intensifier tube and the inside diameter of walls 202 of housing 200.

As shown in FIG. 7, the inner dimension of side wall 202 of housing 200 need only be of sufficient diameter to receive the outermost dimension of the housing of the image intensifier tube. This is a result of residual side arms 180 and 182 having a radial protrusion not extending beyond the diameter of any portion of the housing of the image intensifier tube.

Thus, the present invention provides an internally processed image intensifier inverter tube which may be substituted for the smaller diameter first generation image intensifier tube. This is accomplished by the use of a photocathode housing having depressed flats in the areas where the processing tubes from the antimony generator and the alkali generator are attached. With the tubes crimped off after the evaporation process for coating the photocathode with an antimony and alkali metal, the radial protrusion of the residual tubes is reduced by the depth of the flats. Thus, in the present invention, the radial protrusions of the residual side arm tubes do not extend beyond the photocathode housing, and the image intensifier tube may be mounted in devices originally designed to receive smaller first generation image intensifier tubes.

Even though the area in which the antimony and alkali vapors are injected into the image intensifier tube is positioned inwardly from the conventional tubes, proper flow of alkali vapor into the tube through the alkali processing tube is assured by the special cathode housing shield with a relief depression in front of the alkali vapor tube. The depth of the shield is maintained at a minimum to avoid disturbing the electron optics in the cathode region. The depression directs the alkali vapor between the shield and the side wall of the housing of the photocathode housing and then into the area adjacent the photocathode. Thus, nonuniform coating of the alkali metal on the photocathode is eliminated.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications and substitutions of parts and elements as fall within the scope of the appended claims.

What is claimed is:

1. A cathode housing for a photocathode internally processed image intensifier inverter tube comprising:
   an outer side wall forming a cylindrical opening and a cylindrical cavity for receiving the photocathode of the inverter tube,
   a pair of flattened walll surfaces formed in said side wall, the radial distance of said flattened wall surfaces from the center of said cylindrical opening being less than the radius of said cylindrical opening, and
   a pair of side arms extending outwardly from said flattened wall surfaces, said side arms being sealingly pinched off at the ends thereof to maintain a vacuum inside the inverter tube, the radial protrusion of the ends of said side arms being no greater than the radius of the side walls forming said cylindrical opening.

2. The cathode housing of claim 1 further comprising:
   an inner shield having a circular side wall for being received within said cathode housing, and
   an indention in said side wall in line with one side arm, said indention allowing vapor to enter said outer side wall and then dispersing vapor admitted through said side arm into the cathode housing.

3. The cathode housing of claim 2 further comprising:
   an inner shield having a circular side wall for being received within said cathode housing, and
   an indention in said side wall in line with one side arm, said indention acting to initially direct the vapor away from the photocathode and then dispersing vapor admitted through said side arm into the cathode housing.

4. The cathode housing of claim 2 further comprising:
   an annular bottom wall attached to the bottom edge of said outer side wall, said annular bottom wall extending radially inwardly from said outer side wall, and
   means for maintaining the bottom edge of said indention above said annular bottom wall to produce a gap between the bottom edge of said indention and said bottom wall to permit the flow of vapor therebetween.

5. The cathode housing of claim 4 wherein said bottom edge maintaining means comprises:
   a foot extension attached to the lower edge of said inner shield side wall for positioning the lower edge of said shield above said bottom wall to permit the flow of gases from the side arms into the cathode housing.

6. The cathode housing of claim 2 further comprising:
   an annular bottom wall attached to the bottom edge of said outer side wall, said annular bottom wall extending radially inwardly from said outer side wall, and
   means for maintaining the bottom edge of said inner shield above said annular bottom wall to produce a gap between the bottom edge of said inner shield and said bottom wall when said inner shield is mounted within the said outer side wall.

7. The cathode housing of claim 6 wherein said inner shield has a diameter less than the diameter of said outer side wall to define a space between said inner shield and said outer side wall such that vapor admitted against said indention is directed into the space between said inner shield and outer side wall and then through the gap between the bottom edge of said inner shield and bottom side wall to the photocathode.

8. The cathode housing of claim 6 wherein said bottom edge maintaining means comprises:
   a foot extension attached to the lower edge of said inner shield side wall for positioning the lower edge of said shield above said bottom wall to permit the flow of vapor from the side arms into the cathode housing.

9. The cathode housing of claim 2 wherein said indention comprises:
   a substantially spherical upper portion positioned below the top of said outer side wall, and
   a lower semicircular portion communicating between said upper spherical surface and the bottom edge of the side wall of said inner shield.

10. The cathode housing of claim 2 further comprising:
   a transverse step formed between the upper end of said flattened wall surfaces and said outer side wall, and
   an annular flange extending transversely and outwardly from the side wall of said inner shield, said annular flange of said inner shield mating with said annular step when said inner shield is assemblied within the outer side wall.

11. The cathode housing of claim 1 wherein said flattened wall surfaces are positioned on opposite sides of said outer side wall.

12. In a photocathode internally processed image intensifier inverter tube, structure for connecting vapor processing arms to the tube comprising:
   a photocathode housing having a cylindrical side wall forming a cavity for receiving the photocathode of the inverter tube,
   a pair of flat surfaces formed in said side walls, said flat surfaces being positioned radially inwardly such that the radial distance from the center of said cylindrical side wall to said flat surfaces is less than the radius of said cylindrical side wall, and
   an aperture formed in each flat surface for receiving a vapor processing arm thereat for injecting processing vapor into the photocathode housing, the point of attachment of said processing arms to said cathode housing at said flat surfaces being positioned radially inwardly from the radius of the cylindrical side wall.

13. The structure of claim 12 further comprising:
   an inner shield having a circular side wall and positioned within said cathode housing, and
   an indention in said side wall in line with one of said vapor processing arms, said indention acting to initially direct the vapor away from the photocathode and then dispersing the vapor admitted through the side arm into the cathode housing.

14. The structure of claim 13 further comprising:
   an aperture through the side wall of said inner shield in line with said other processing arms for receiving vapor from the other processing arm into the cathode housing.

15. The structure of claim 13 further comprising:
   an annular bottom wall attached to the bottom edge of the cylindrical wall of said cathode housing, said annular bottom wall extending radially inwardly from said cathode housing side wall, and means for maintaining the bottom edge of said indention above said annular bottom wall when said inner ring is fitted in the cathode housing to produce a gap between the bottom edge of said indention and said bottom wall to permit flow of vapor therebetween.

16. The structure of claim 15 wherein said bottom edge maintaining means comprises a foot extension attached to the lower edge of said inner shield side wall for positioning the lower edge of said indention above said bottom wall to permit the flow of gases from the side arms into the cathode housing.

17. The structure of claim 13 further comprising:

an annular bottom wall attached to the bottom edge of the cylindrical wall of said cathode housing, said annular bottom wall extending radially inwardly from said cathode housing side wall, and means for maintaining the bottom edge of said inner shield above said annular bottom wall to produce a gap between the bottom edge of said inner shield and said bottom wall when the inner shield is mounted within said cathode housing.

18. The cathode housing of claim 17 wherein said inner shield has a diameter less than the diameter of said photocathode housing side wall to define a space between said inner shield and said side wall such that vapor admitted against said indention is directed into the space between said inner shield and side wall and then through the gap between the bottom edge of said inner shield and side wall to the area within said inner shield.

19. The structure of claim 17 wherein said bottom edge maintaining means comprises a foot extension attached to the lower edge of said inner shield side wall for positioning the lower edge of said shield above said bottom wall to permit the flow of gases from the side arms into the cathode housing.

20. The structure of claim 13 wherein said indention comprises:

a substantially spherical upper portion positioned below the top of said cathode housing, and a lower semicircular portion communicating between said upper spherical portion of said indention and the bottom edge of the side wall of said inner shield for initially directing vapor from said processing arms away from the photocathode.

21. The structure of claim 13 further comprising:

a transverse step formed between the upper end of said flat surfaces in the cathode housing and said cathode housing cylindrical side wall, and an annular flange extending transversely and outwardly from the side wall of said inner shield, said annular flange of said inner shield mating with said annular step when said inner shield is assembled within said cathode housing.

22. The structure of claim 12 wherein said flat surfaces are positioned on opposite sides of said cathode housing.

* * * * *